US005133553A

United States Patent [19]

Divnick

[11] Patent Number: 5,133,553

[45] Date of Patent: Jul. 28, 1992

[54] ADJUSTABLE GOLF CLUB

[76] Inventor: Stevan M. Divnick, 1680 East St., Spring Valley, Ohio 45370

[21] Appl. No.: 655,111

[22] Filed: Feb. 14, 1991

[51] Int. Cl.[5] ..... A63B 53/08

[52] U.S. Cl. ..... 273/79; 273/80 D; 273/80.1; 403/97

[58] Field of Search ..... 273/79, 168, 80.1, 80 D, 273/81.2, 80.2; 403/97

[56] References Cited

U.S. PATENT DOCUMENTS

| | | | |
|---|---|---|---|
| 1,137,457 | 4/1915 | Breitenbaugh | 273/79 |
| 2,477,438 | 7/1949 | Brouwer | 273/79 |
| 2,882,053 | 4/1959 | Lorthiois | 273/79 |
| 3,840,231 | 10/1974 | Moore | 273/79 |
| 4,674,747 | 6/1987 | Mazzocco et al. | 273/80 D |

FOREIGN PATENT DOCUMENTS

| | | | |
|---|---|---|---|
| 23578 | of 1901 | United Kingdom | 273/79 |

OTHER PUBLICATIONS

"Taperscopic" TM Putter.

"Golf Digest", Magazine, May 1974 Issue, p. 157, Advertisement for R&G Adjustable Golf Club.

*Primary Examiner*—Edward M. Coven

*Assistant Examiner*—Sebastiano Passaniti

[57] ABSTRACT

A club head and hosel assembly providing adjustable loft angles wherein the adjustment ring is located within a housing in the hosel and a one-way ratchet engagement is used to adjust the loft angle by alternately rotating the club head in one direction and then the other with respect to the hosel.

19 Claims, 3 Drawing Sheets

ADJUSTABLE GOLF CLUB

BACKGROUND OF THE INVENTION

In the game of golf, a variety of clubs are used with varying loft angles (usually in 4 degree increments) which, when impacting the ball, impart more or less height and distance on the ball. Clubs called "drivers" have a slight angle away from vertical and are used to drive the ball a great distance horizontally with a relatively flat trajectory. As the player successfully advances the ball toward the green, less distance is required and he may select from a number of "irons" which have varying loft angles away from vertical. The shorter the required distance, the greater the angle required. Upon reaching the green, the ball is more gently hit with a "putter" so that it rolls along the grass which requires virtually no loft angle. Most golfers use up to 14 clubs with varying lofts at approximately four degree increments to play the game.

The need for multiple clubs creates a number of disadvantages such as significant cost to purchase a complete or partial set, a bag to contain said clubs, and a pull cart, a motorized riding cart, or caddy to transport the bag of clubs during the game.

DESCRIPTION OF THE PRIOR ART

While a number of adjustable and portable golf clubs have been developed which attempt to replace the need for multiple clubs, they have had significant disadvantages. Most designs have used either teeth or compression to lock the desired loft angle with compression not providing sufficient locking effect. For teeth to achieve an adjustable club with every conventional loft angle corresponding to a full set of clubs would require at least 90 teeth thereby causing the mechanism to be too large and heavy for practical use. Therefore, some of the designs have allowed for only some of the loft angles which reduces the ability to predict and affect desired shot making. To achieve all conventional loft angles, other club designs have used a secondary interface part with differing amounts of grooves or teeth to create a vernier adjustment (See Lorthiois U.S. Pat. No. 2,882,053, Moore U.S. Pat. No. 3,840,231, and Craig U.S. Pat. No. 1,429,569) but which was more confusing to adjust because of the need to align up to 5 index mark options (Moore). In all three examples, the mechanism was still very large and heavy and with two designs (Moore and Craig) was incorporated onto the back of the club head where it protruded and, when adjusted to the steeper loft settings, scraped the ground before impacting the ball resulting in a poor quality shot. Also, most of the mechanisms were exposed to sand and dirt which could interfere with smooth and solid adjustment.

It is desirable and the norm with modern club design to have a majority of weight on the bottom edge of the club head to create a low center of gravity with additional weight distributed around the perimeter of the head (referred to as "perimeter weighting" or "cavity back" design) to create a larger "sweet spot" and more solid and forgiving contact with the ball. Because of the size of the mechanism with most previous adjustable clubs, it was necessary to place the mechanism at mid-height (See Lorthiois, Moore, and Craig) and/or on the back of the head with no ability to add weight to the bottom or perimeter of the club. This created a much higher center of gravity than with conventional clubs resulting in poor performance and a small sweet spot.

It is further desirable in modern club design to align the shaft just in front of the face of the club head creating an offset alignment which yields more solid contact. The mechanism on the back of club heads on previous adjustable designs required the shaft alignment to be behind the face further reducing the performance. In modern golf club design, said offset is desired so that the shaft is somewhat past the ball when the club face contacts the ball. This design diminishes the undesirable "gear effect" caused by the ball twisting the club head away from the desired angle causing an errant shot. It is further desired that the offset progress from club to club so that the driver and putter, for instance, have maximum offset and the steeper wedges have hardly any since the gear effect is diminished when the loft angle is increased.

Some designs incorporated the adjustment device to the side of the head (Pester U.S. Pat. No. 2,091,794, Lorthiois, Cushing U.S. Pat. No. 2,477,438) but not for purposes of perimeter weighting or offset hosel alignment. The Pester and Brouwer designs, in fact, aligned the hosel toward the back of the club head while Cushing and Brouwer remained at the side.

As mentioned earlier, most designs incorporated only one set of teeth which limited the loft options because of the size and weight required to fit enough teeth to accommodate every conventional option. For instance, the Pester design would require at least 90 teeth around the circumference of the gear in order to achieve each of the loft selections indicated in the patent. The teeth would be too small to engage solidly during ball contact and to small manufacture using the preferred investment casting method. The Lorthiois design, although incorporating a secondary reduction ring to allow for finer loft adjusttments and mounting the mechanism to the side of the head, exposed the teeth to sand and dirt, required the hosel to be substantially distant from the head so as to seriously reduce solid contact with the ball, and required the purposeful manipulation of the ring and relative alignment of three indices.

Most previous adjustable clubs also required a secondary leverage tool to tighten and loosen the mechanism which was clumsy and required unacceptable time during play to achieve the adjustment and could potentially be misplaced or lost. Finger-grip knurled knobs do not allow enough leverage to lock the devices solidly (Moore, Lorthiois) thereby requiring an additional leverage device (Moore). Cushing and Brouwer included metal leverage handles with their design which added weight to the mechanism away from the sweet spot thereby reducing the solid ball contact even more. Additionally, their levers were threaded to fit a male threaded stud which resulted in various alignment positions of the lever when tightened relative to the straight-up hosel and shaft depending on the uncontrollable threading process on both the female lever and the male stud.

The combined complexity of having to manipulate the secondary ring separately from the head and hosel, having to understand and align up to five indices, and having to use a separate leverage tool rendered even the best of the prior art difficult to use and required too much time to adjust during the game resulting in the lack of any significant popularity and commercial success.

Previous attempts to make the playing length of the shaft variable using tongue-and-groove channels or other means have resulted in complex locking devices which were difficult to use, required external tools, were heavy which diminished playability, and did not lock tightly enough to eliminate twisting of the shaft or vibration upon ball contact.

Previous telescopic shafts using frictional engagement to lock for play have used only two sections which does not allow for a collapsed length short enough to fit into a conventional attache case for travel. It has also been difficult to disengage said sections from the fully-extended position after play is completed. Kategian U.S. Pat. No. 3,528,660, Rupnow U.S. Pat. No. 3,214,169, and Mazzocco U.S. Pat. No. 4,674,747 incorporated plugs or covers in the grip-end to aid in disengaging the shaft by tapping said ends on a hard surface. The design of the plugs was such that they required a relatively expensive manufacturing process of either machining or casting.

With most collapsible shaft designs, when in the closed (short) position, the club head is allowed to undesirably rotate or slide out of the closed position. To eliminate this, some patents have incorporated hooks, bayonet slots, or one-position frictional engagement between the inner diameter of the outer (handle) shaft section and the tapered outside diameter of the hosel. In all cases, the secured closed position required the handle section to always hook or lock at only one position thereby not allowing for various lengths of the inner shaft pieces to fit within the handle. My invention allows for the shaft to be manufactured at various lengths and still fit within the handle when closed and solidly contained by the handle thereby offering an important option to the player.

Further, and relative to the potential for pinching the hands as mentioned in Mazzocco, pinching would only occur in any of the collapsible shaft designs if the hand is holding the shaft near the head when disengaging. This is illogical since it is easier to hold the head with one hand and the grip with the other thereby completely eliminating the potential of pinching.

SUMMARY OF THE INVENTION

This invention comprises an adjustable golf club which can be adjusted to every loft position as with a complete set of conventional clubs and to every half loft position for additionally precise shot making, to multiple putter angles, and to a variety of steep angle loft options (pitching and sand wedges) if desired which allows the player to more precisely control the distance and height of his shots. The adjustment mechanism is of a sufficiently small size and design so that it can be placed low and to the side (heel-end) of the club head which eliminates interference with the ground on steep angle shots, allos bottom and perimeter weight distribution, and allows an offset alignment of the shaft with the face of the club head. The perimeter weighting also creates a large cavity with a relatively flat surface on the back of the head on which corporate logos can be embossed or painted which allows the club to be sold to a previously untapped multi-billion dollar per year premium and incentive market. A light weight leverage extention for the threaded tightening nut is incorporated into the design so as to eliminate the need for a separate tool and the lever can be located in a straight up position when tightened regardless of thread location or wear characteristics of the threads over long periods of use. Additionally, the lever assists in holding the handle section of the shaft when closed.

The vernier adjustment mechanism is designed into a sealed chamber in the golf club which eliminates the entrance of dirt, sand, and other foreign objects. The vernier adjustment is accomplished by the use of first and second interlocking members which have a small degree differential between their respective positions of adjustment. The degree differential is controlled by the number of teeth on the respective interlocking members explained herein, but not limited within the scope of this invention, to yield 2 degree increments. There are 20 teeth on one side of the circular interlocking member which creates an 18-degree movement when rotated one increment, and 18 teeth on the other side of the member which creates a 20-degree movement when rotated one increment. These two surfaces, when rotated in pairs of opposite directions which happens automatically because of the one-way teeth, thus yield a differential of 2 degrees advancing toward the steeper loft angles which is required as the player approaches the green. Selection of the desired loft angle is accomplished by simply aligning the primary index mark located on the back of the club head with the secondary index mark which corresponds to the conventional clubs desired. Aligning the primary index mark to the spaces between the secondary marks yields half-lofts. It should be understood that the primary index mark can be on the hosel gear housing and the secondary marks can be on the back of the head which would yield the same simple alignment technique.

Critical to understanding the value of my invention is the automatic advancement of the lofts created by the one-way teeth and the hidden reduction ring. This eliminates the need to manipulate the reduction ring and allows for very quick loft adjustment so as not to slow down the critical pace of play.

Finer adjustments can be achieved by using 36 teeth on one side of the vernier ring member and 40 teeth on the other which would result in 1-degree or ¼-loft adjustments. Fewer loft-angles would be achieved by using 10 teeth on one side and 9 teeth on the other which would result in 4-degree increments and would correspond to every conventional loft angle, but nothing in between.

This invention further provides a telescopic and collapsible shaft using at least three members which allows full conventional length when extended and a collapsed length sufficiently short so as to fit into a small business attache case or other convenient travel space. Each section of the shaft is of a tapered shape from top to bottom with each section smaller than the next so that the upper end of the smallest section extends sufficiently into the lower end of the middle section in such a way that the outside surface of the smaller section is locked against the inside surface of the middle section due to the frictional engagement of their relative sizes. The middle and largest section interlock in a like manner. A durable hard shaft cap made from metal or other suitable material, designed so that it can be inexpensively manufactured using a stamping machine, is cemented or crimped over the top end of the handle section and is not covered by the handle grip but is flush with its uppermost end surface. The shaft cap is impacted on a hard surface such as cement or wood which disengages the shaft sections from each other upon said impact. When collapsed or closed, the inside and outside dimensions of the lower end of the handle section frictionally grip the full length of the hosel due to the spring-like flexing of the tubular shaft material which is forced over the bulge or ridge along the hosel. The light weight lever aids in holding the shaft with frictional pressure along the shaft's outside surface. The handle section is firmly engaged at any position along the hosel which accommodates varying lengths of the smaller inner shaft sections depending on the player's size and preference.

These and other objects of this invention will become more apparent upon a reading of the following brief specification, considered and interpreted in view of the accompanying drawings.

DESCRIPTION OF THE PREFERRED EMBODIMENTS

Figure 1:
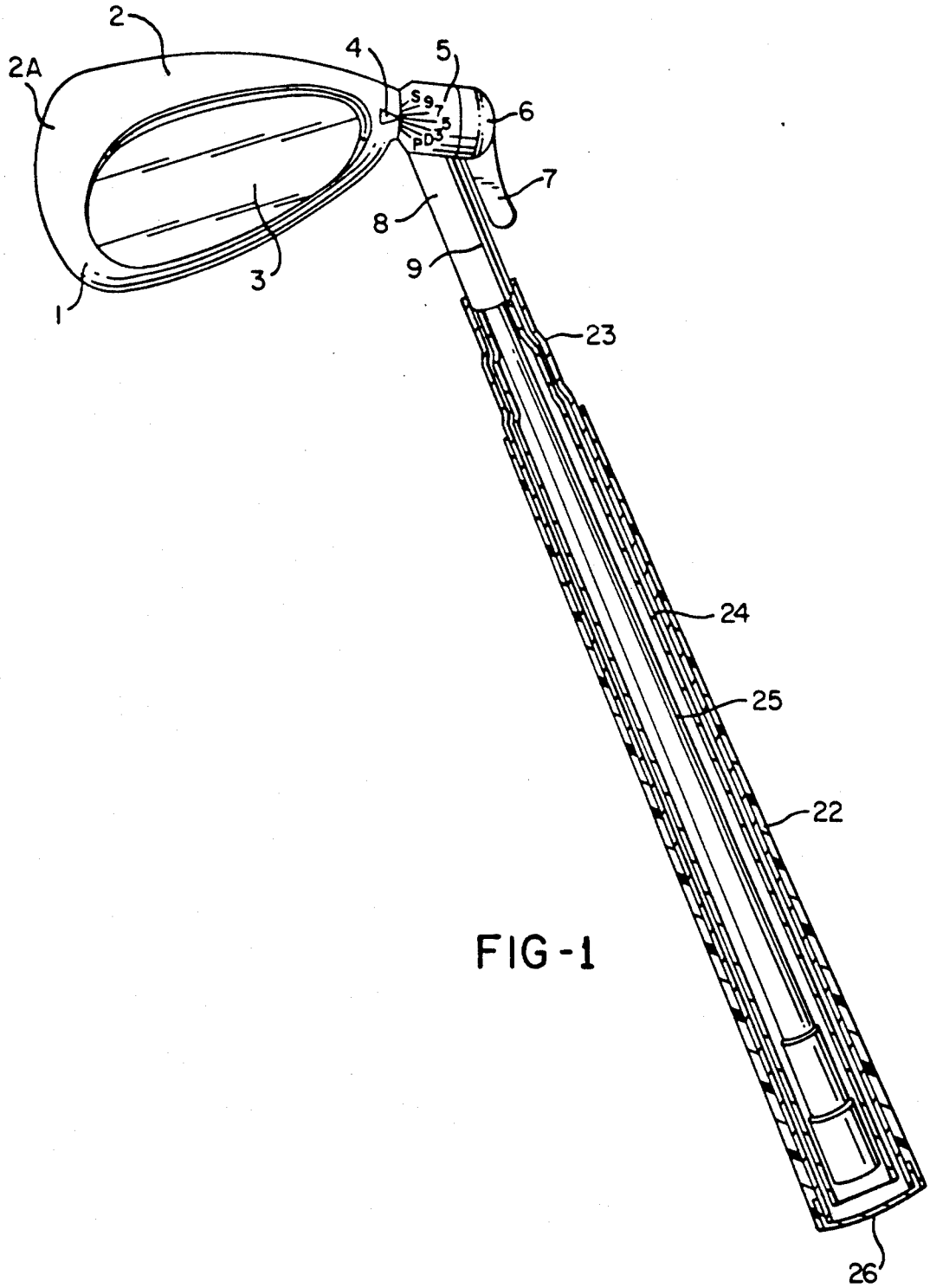
FIG. 1 is a back view of the club with the head in a locked playable position set to a 5-iron and showing the shaft in a closed (collapsed) position.

Referring primarily to FIG. 1, the head 1 depicts the perimeter weighting concentrating the majority of the weight on the bottom 2 and end 2A of the head with a relatively flat surface in the pocket or "cavity back" area 3 on which corporate names and logos can be placed.

The primary index mark 4 is shown aligned with the 5-iron selection of the secondary index marks 5 shown on the hosel gear housing 16.

The light weight lever 6 and handle 7 can be made from plastic or any other suitable material. The raised ridge 9 along the hosel 8 is of a sufficient height that the total diameter of the hosel 8 measured at the ridge 9 causes the handle portion of the shaft 23 to slide tightly over the hosel 8 due to the flexible warping of the handle shaft 23 section.

The shaft is shown in a collapsed position with the lower section 25 and mid-section 24 contained inside the handle section 23 with the handle section 23 fitting tightly over the hosel 8 in the club's shortest or closed position. The shaft cap 26 is shown relatively flush with the grip 22 on the extreme end of the handle section 23. The shaft cap 26 is secured to the grip end of the handle section of the shaft 23 using epoxy or crimping and serves to contain the mid-section 24 which would otherwise be able to slide out when the shaft is closed and to protect the end of the handle section 23 and grip 22 and to aid in disengaging the shaft from its playing length. The raised ridge 9 along the hosel 8 frictionally engages the inner diameter of the smallest end of the handle section 23 by a spring-like warping or expanding of the diameter of the handle section 23 over the ridge 9 and a corresponding friction of the outside diameter surface of the handle section 23 against the lever handle 7. Frictional engagement can take place at any point along the hosel 8 and lever handle 7 which allows the club to be manufactured in varying lengths of the lower shaft section 25 and not interfere with the secure engagement as described herein. For instance, if the total shaft length is 38.5", the lower section of the shaft 25 extends all the way to the inside of the shaft cap 26 when the handle section 23 is completely closed down to the hosel gear housing 16. If a player wants the club to be 39.25" (0.75" longer) to suit their size and style, the lower shaft section 25 is manufactured 0.75" longer which means that the handle section 23 fits down to within 0.75" of the hosel gear housing 16 but holds the club head and hosel just as firmly as it grips the full length of the hosel 8 and ridge 9.

To extend the shaft to its playing position, the player holds the head 1 in one hand and the shaft grip 22 in the other and quickly jerks the hands away from each other to snap the shaft sections into their frictional engagement. To close the shaft, the hands are held in the same extreme positions as with extending said shaft, and the shaft cap end of the shaft 26 is impacted on a hard surface such as cement or wood. The impact will disengage first one section then the other without potential harm to the hands since they are not in the proximity of the shaft section ends. The handle section 23 is then forced down over the hosel 8 which holds the club in its collapsed position.

Figure 2:
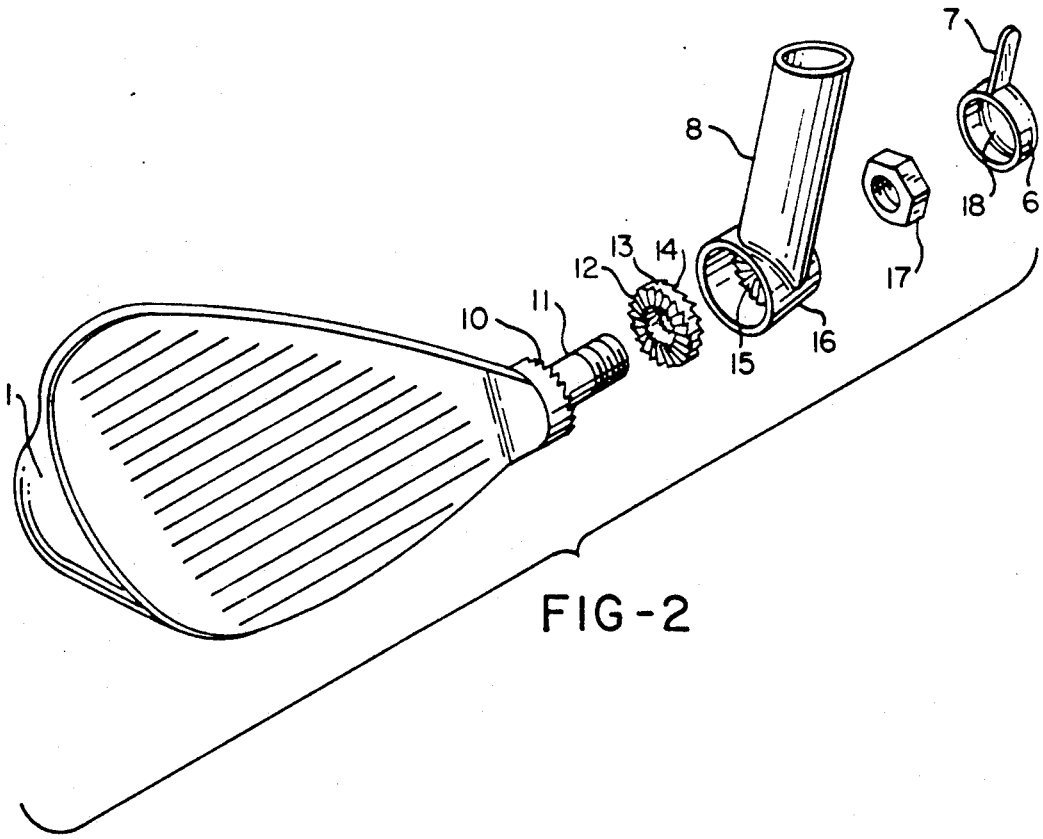
FIG. 2 is an exploded view of the head, locking members, shaft hosel, locking nut, and lever handle.

Referring primarily to FIG. 2, the 18 one-way ratchet teeth 10 on the head mate with 18 teeth 12 on the reduction ring 13. The 20 opposite one-way teeth 15 inside the hosel gear housing 16 mate with the 20 teeth 14 on the ring 13. When fully assembled as in FIG. 1, the conventionally threaded nut 17 is tightened onto the male-threaded head stud 11. Because the manufacturing process of threading yields random positioning of the start of the threads, the final position of the nut 17 is also random. So that the lever handle 7 is relatively aligned with the hosel 8, a series of multiple parallel female grooves 18 are formed into the lever housing 6 which allow the lever housing 6 to be pressed onto the 6 corners of the conventional nut 17 in alignment with the hosel 8. The number of grooves 18 will be at least 12 which will yield twice as many alignment positions for the lever 6 as would the nut 17. It is important to understand, from a simplicity of operation perspective as will become evident in the following paragraphs, that both the nut 17 and the ring gear 13 are not visible unless the entire club is disassembled which is easily accomplished for cleaning.

To modify the loft position, the lever 6 is turned counter-clockwise 1 or 2 turns which is enough for the teeth on the relative surfaces to rotate past each other. Then, holding the golf club upside down with the head 1 in one hand and the shaft FIG. 4 in the other hand, the head 1 is rotated first one way then the other. It does not matter which direction it is rotated first since the respective ring teeth 12 and 14 ratchet only one-way in opposite directions and will always advance the head 1 two degrees (half loft) per pair of rotations. For instance, presume that the player has just hit the ball with the club in the "D" (driver) position and for his next shot wishes to advance the loft to the 3-iron position which is eight degrees (4 pairs of rotations) advanced from the driver. The player can either make 4 pairs of back and forth rotations or 4 "clicks" one way and 4 "clicks" the other way. This series of movements would automatically align the main index mark 4 with the 3-iron mark found in the secondary index marks 5, and the lever 6 is then tightened clockwise until tight.

Figure 3:
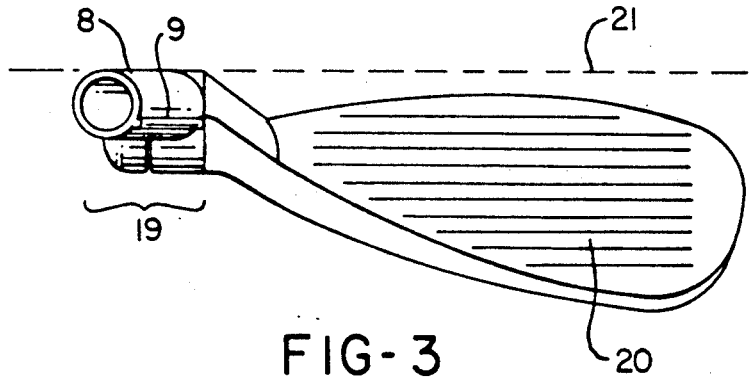
FIG. 3 is a top view to specifically show the offset shaft alignment and hosel ridge.

FIG. 3 is a top elevational view to specifically show the hosel ridge 9 and the offset alignment of the shaft as illustrated by line 21. My invention positions the adjusting mechanism and hosel assembly 19 forward of the club face 20 in such a way that the maximum offset is automatically achieved for the driver and putter with automatic incremental reductions in offset with each succeeding loft selection until there is minimal offset for the steeper wedges. FIG. 3 is shown with the club face 20 at approximately a 5-iron loft setting.

Figure 4:
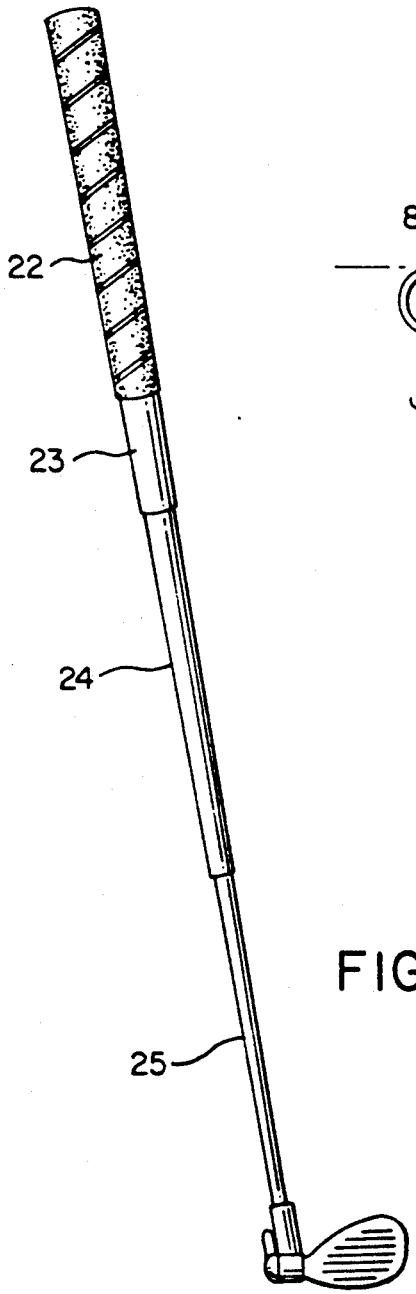
FIG. 4 is a perspective view of the club shown in its extended position.

Referring primarily now to FIG. 4 which shows the club and tapered shaft in its extended playing position, the handle section of the shaft 23 includes the grip 22. The mid-section of the shaft 24 fits into the handle section 23 and is locked firmly in place due to the frictional engagement of the inner surface of the lower end of the handle section 23 and the outer surface of the upper end of the mid-section 24. Likewise, the lower section 25 fits into the mid-section 24. The lower end of the lower section 25 is epoxy-welded into the hosel 8. It is understood that my invention uses, but is not limited to, at least 3 shaft sections in order to yield a shorter club when the shaft is disengaged and collapsed for travel.

While a full and complete description of the invention has been set forth in accordance with the dictates of the patent statutes, it is to be understood that this invention is not intended to be limited to the specific embodiments herein shown. Accordingly, modifications of the invention may be resorted to without departing from the spirit hereof or the scope of the appended claims.

I claim:

1. A golf club head and hosel assembly having adjustable loft angles which comprises:

a club head, a ring member, a hosel, and a nut for attaching said hosel and said ring member to said club head;

said club head having a heel portion from which a threaded cylindrical post extends and having a plurality of teeth formed in said heel portion at a base of said post, said hosel having a gear housing formed at one end thereof, said gear housing being sufficiently deep to receive and enclose said ring member in said housing when said housing and said ring member are assembled with said club head, and a plurality of teeth at a base of said gear housing for engaging said ring member, said ring member having first and second ends having first and second axially extending surfaces and having first and second sets of teeth formed, respectively said first and second ends of said surfaces for engaging, respectively, said teeth in said heel portion and said teeth in said gear housing, said ring member being assembled with said club head and said hosel such that said first and second sets of teeth in said ring member engage, respectively, said teeth in said heel portion of said club head and said teeth in said gear housing and said ring member is protectively enclosed and concealed from view within said gear housing, and said nut member being threadedly tightened on said post to thereby hold said assembly together.

2. The golf club head and hosel assembly of claim 1 wherein said assembly consists essentially of said club head, said ring member, said hosel, and said nut.

3. The golf club and hosel assembly of claim 1 wherein loft index markings are present on said club head and said hosel.

4. The golf club head and hosel assembly of claim 1 wherein said teeth in said heel portion, said sets of teeth in said ring member and said teeth in said gear housing provide a one-way interlocking engagement wherein by loosening said nut and rotating said club head in a first direction, said teeth in said heel portion rotate with respect to said first set of teeth in said ring member, and by rotating said club head in an opposite second direction, said second set of teeth in said ring member rotate with respect to said teeth in said gear housing.

5. The golf club head and hosel assembly of claim 4 wherein said hosel includes a ridge member extending from an outer surface thereof.

6. The golf club head and hosel assembly of claim 5 wherein said assembly further comprises a locking lever, said lever having a housing formed therein for receiving and engaging said nut in multiple positions such that by rotating said lever, said nut can be tightened and loosened and said lever can aligned with said hosel when said nut is tightened.

7. The golf club and hosel assembly of claim 6 wherein said club head is perimeter weighted.

8. The golf club head and hosel assembly of claim 6 wherein said club head and said hosel are aligned in an incrementally reduced offset alignment.

9. An improved golf club with adjustable loft angles comprising a golf club shaft and a golf club head and hosel assembly, said golf club head and hosel assembly including a club head, a ring member, a hosel, and a nut for attaching said hosel and said ring member to said club head;

said club head having a heel portion from which a threaded cylindrical post extends and having a plurality of teeth formed in said heel portion at a base of said post, said hosel having a gear housing formed at one end thereof, and gear housing being sufficiently deep to receive and enclose said ring member in said housing when said housing and said ring member are assembled with said club head, and a plurality of teeth at a base of said housing for engaging said ring member, said ring member having first and second end and having first and second axially extending surfaces and having first and second sets of teeth formed respectively, in said first and second ends of said surfaces for engaging, respectively, said teeth in said heel portion and said teeth in said gear housing, said ring member being assembled with said club head and said hosel such that said first and second sets of teeth in said ring member engage, respectively, said teeth in said heel portion of said club head and said teeth in said gear housing and said ring member is protectively enclosed and concealed from view within said gear housing, and said nut member being threadedly tightened on said post to thereby hold said assembly together.

10. The golf club of claim 9 wherein said golf club head and hosel assembly consists essentially of said club head, said ring member, said hosel and said nut.

11. The golf club of claim 9 wherein loft index markings are present on said club head and said hosel.

12. The golf club of claim 9 wherein said golf club shaft is a collapsible shaft.

13. The golf club shaft of claim 12 wherein said teeth in said heel portion, said sets of teeth in said ring member and said teeth in said gear housing provide a one-way interlocking engagement wherein by loosening said nut and rotating said club head in a first direction, said teeth in said heel portion rotate with respect to said first set of teeth in said ring member, and by rotating said club head in an opposite second direction, said second set of teeth in said ring member rotate with respect to said teeth in said gear housing.

14. The golf club of claim 12 wherein said golf club shaft includes three telescopic sections.

15. The golf club of claim 14 wherein said hosel includes a ridge member extending from an outer surface thereof.

16. The golf club of claim 14 wherein said golf club further comprises a cap at an end of said shaft opposite said hosel.

17. The golf club of claim 14 wherein said assembly further comprises a locking lever, said lever having a housing formed therein for receiving and engaging said nut in multiple positions such that by rotating said lever, said nut can be tightened and loosened and said lever can be aligned with said hosel when said nut is tightened.

18. The golf club of claim 17 wherein said club head is perimeter weighted.

19. The golf club of claim 17 wherein said club head and said hosel are aligned in an incrementally reduced offset alignment.

* * * * *